US009554227B2

(12) United States Patent
Kim et al.

(10) Patent No.: US 9,554,227 B2
(45) Date of Patent: Jan. 24, 2017

(54) METHOD AND APPARATUS FOR PROCESSING AUDIO SIGNAL

(75) Inventors: Sun-min Kim, Yongin-si (KR); Young-woo Lee, Suwon-si (KR); Yoon-jae Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 669 days.

(21) Appl. No.: 13/561,645

(22) Filed: Jul. 30, 2012

(65) Prior Publication Data

US 2013/0028424 A1 Jan. 31, 2013

(30) Foreign Application Priority Data

Jul. 29, 2011 (KR) ..... 10-2011-0076148

(51) Int. Cl.
*H04S 1/00* (2006.01)
*H04S 7/00* (2006.01)

(52) U.S. Cl.
CPC ..... *H04S 1/002* (2013.01); *H04S 7/30* (2013.01); *H04S 2400/11* (2013.01)

(58) Field of Classification Search
CPC .. H04S 1/002; H04S 2400/11; H04S 2420/01; H04S 5/005; H04S 3/002; H04S 7/30; H04R 5/00; H04N 7/142; H04N 7/15; H04N 21/439; H04N 21/44008; H04N 21/8106
USPC ..... 381/1, 2, 17, 18, 306, 307, 310, 61, 63,381/74; 700/94
See application file for complete search history.

(56) References Cited

U.S. PATENT DOCUMENTS

| | | | | |
|---|---|---|---|---|
| 5,862,229 | A | 1/1999 | Shimizu | |
| 7,480,386 | B2 * | 1/2009 | Ogata | 381/310 |
| 8,705,778 | B2 | 4/2014 | Zhan et al. | |
| 2003/0053680 | A1 * | 3/2003 | Lin et al. | 382/154 |
| 2007/0182865 | A1 * | 8/2007 | Lomba et al. | 348/725 |
| 2007/0203598 | A1 | 8/2007 | Seo et al. | |
| 2011/0050944 | A1 | 3/2011 | Nakamura et al. | |
| 2011/0116665 | A1 * | 5/2011 | King et al. | 381/300 |
| 2012/0008789 | A1 | 1/2012 | Kim et al. | |
| 2014/0119581 | A1 * | 5/2014 | Tsingos et al. | 381/300 |

FOREIGN PATENT DOCUMENTS

| | | | |
|---|---|---|---|
| CN | 101350931 | A | 1/2009 |
| EP | 2154911 | A1 | 2/2010 |

(Continued)

OTHER PUBLICATIONS

Communication (PCT/ISA/210), dated Jan. 31, 2013, issued by the International Patent Office in counterpart International Application No. PCT/KR2012/005955.

(Continued)

*Primary Examiner* — David Ton
(74) *Attorney, Agent, or Firm* — Sughrue Mion, PLLC

(57) ABSTRACT

An audio signal processing apparatus including an index estimation unit that receives three-dimensional image information as an input and generates index information for applying a three-dimensional effect to an audio object in at least one direction of right, left, up, down, front, and back directions, based on the three-dimensional image information; and a rendering unit for applying a three-dimensional effect to the audio object in at least one direction of right, left, up, down, front, and back directions, based on the index information.

20 Claims, 9 Drawing Sheets

(56) References Cited

FOREIGN PATENT DOCUMENTS

| | | | | |
|---|---|---|---|---|
| EP | 2 323 425 | A1 | | 5/2011 |
| JP | 2006-128816 | A | | 5/2006 |
| JP | 2009-278381 | A | | 11/2009 |
| KR | 2010066289 | A | * | 6/2010 |
| KR | 10-2011-0072923 | A | | 6/2011 |
| KR | 10-2011-0105715 | A | | 9/2011 |
| KR | 10-2012-0004909 | A | | 1/2012 |
| WO | 2006121957 | A2 | | 11/2006 |

OTHER PUBLICATIONS

Communication (PCT/ISA/237), dated Jan. 31, 2013, issued by the International Patent Office in counterpart International Application No. PCT/KR2012/005955.

Communication dated Feb. 18, 2015 issued by the European Patent Office in counterpart European Patent Application No. 12819640.9.

Communication dated Jan. 6, 2015 issued by the Japanese Patent Office in counterpart Japanese Patent Application No. 2014-523837.

Communication issued on Jun. 3, 2015 by the State Intellectual Property Office of PR China in related Application No. 201280048236.1.

Communication issued on Jun. 18, 2015 by the European Patent Office in related Application No. 12819640.9.

Communication issued on Aug. 18, 2015 by the Japanese Patent Office in related Application No. 2014-523837.

Communication dated Feb. 25, 2016 issued by the State Intellectual Property Office of P.R. China in counterpart Application No. 201280048236.1.

Communication dated Jun. 3, 2016, issued by the State Intellectual Property Office of P.R. China in counterpart Chinese Application No. 201280048236.1.

* cited by examiner (b)

METHOD AND APPARATUS FOR PROCESSING AUDIO SIGNAL

CROSS-REFERENCE TO RELATED PATENT APPLICATION

This application claims priority from Korean Patent Application No. 10-2011-0076148, filed on Jul. 29, 2011, in the Korean Intellectual Property Office, the disclosure of which is incorporated herein by reference in its entirety.

BACKGROUND

1. Field

Methods and apparatuses consistent with exemplary embodiments relate to a method and apparatus for processing an audio signal, and more particularly, to a method and apparatus for processing an audio signal, which generate stereophonic sound.

2. Description of the Related Art

Due to the development of imaging technology, a user may view a 3D stereoscopic image. The 3D stereoscopic image exposes left viewpoint image data to a left eye and right viewpoint image data to a right eye in consideration of binocular disparity. A user may recognize an object that appears to realistically jump out from a screen or go back into the screen.

Also, along with the development of imaging technology, user interest in sound has increased and in particular, stereophonic sound has been significantly developed. In current stereophonic sound technology, a plurality of speakers is placed around a user so that the user may experience localization at different locations and perspective. For example, stereophonic sound is obtained by using a 5.1 channel audio system for outputting an audio signal that is divided into six audio signals by using six speakers. However, in stereophonic sound technology, stereophonic sound corresponding to a change in a three-dimensional effect of an image object may not be provided to a user.

Thus, there is a need for a method and apparatus for generating stereophonic sound corresponding to a change in a three-dimensional effect of an image object. In addition, it is important to increase the three-dimensional effect of an audio object. Accordingly, there is a need for a method and apparatus for increasing a three-dimensional effect.

SUMMARY

Exemplary embodiments provide a method and apparatus for processing an audio signal, which generate stereophonic sound corresponding to a change in a three-dimensional effect of an image object.

Exemplary embodiments also provide a method and apparatus for processing an audio signal, which increase a three-dimensional effect of an audio object.

According to an aspect of an exemplary embodiment, there is provided an audio signal processing apparatus including an index estimation unit that receives three-dimensional image information as an input and generates index information for applying a three-dimensional effect to an audio object in at least one direction from among right, left, up, down, front, and back directions, based on the three-dimensional image information; and a rendering unit which applies a three-dimensional effect to the audio object in at least one direction from among right, left, up, down, front, and back directions, based on the index information.

The index estimation unit may generate the index information include sound extension information in the right and left directions, depth information in the front and back directions, and elevation information in the up and down directions.

The three-dimensional image information may include at least one of location information of an image object having at least one from among a maximum disparity value, a minimum disparity value, and a maximum or minimum disparity value for each respective image frame.

When the three-dimensional image information may be input for each respective frame, the location information of the image object may include information about a sub-frame obtained by dividing one screen corresponding to one frame into at least one sub-frame.

The sound extension information may be obtained based on a location of the audio object in the right and left directions, which is estimated by using at least one from among the maximum disparity value and the location information.

The depth information may be obtained based on a depth value of the audio object in the front and back directions, which is estimated by using the maximum and/or minimum disparity value.

The elevation information may be obtained based on a location of the audio object in the up and down directions, which is estimated by using at least one from among the maximum disparity value and the location information.

In at least one case from among a case when the audio object and an image object do not correspond to each other and a case when the audio object corresponds to a non-effect sound, the index estimation unit may generate the index information so as to reduce a three-dimensional effect of the audio object.

The audio signal processing apparatus may further include a signal extracting unit which receives a stereo audio signal as an input, extracts right/left signals and a center channel signal in the stereo audio signal, and transmits the extracted signals to the rendering unit.

The index estimation unit may include a sound source detection unit which receives at least one from among the stereo audio signal, the right/left signals, and the center channel signal as an audio signal, analyzes at least one from among a direction angle of the input audio signal and energy for each respective frequency band, and distinguishes the effect sound and the non-effect sound based on a first analysis result; a comparing unit which determines whether the audio object corresponds to the image object; and an index generating unit which generates index information so as to reduce a three-dimensional effect of the audio object in at least one case from among a case when the image object and the audio object do not correspond to each other and a case when the audio object corresponds to the non-effect sound.

The sound source detection unit may receive at least one from among the stereo audio signal, the right/left signal, and the center channel signal, tracks a direction angle of an audio object included in the stereo audio signal, and distinguishes an effect sound and a non-effect sound based on a track result.

When a change in the direction angle may be equal to or lower than a predetermined value or when the direction angle converges in the right and left directions, the sound detection unit determines that the audio object corresponds to the effect sound.

When a change in the direction angle is equal to or less than a predetermined value or when the direction angle converges to a central point, the sound detection unit may determine that the audio object corresponds to a static sound source.

The sound detection unit may analyze an energy ratio of a high frequency region between the right/left signal and the center channel signal, and when an energy ratio of the right/left signal is lower than an energy ratio of the center channel signal, the sound detection unit may determine that the audio object corresponds to the non-effect sound.

The sound detection unit may analyze an energy ratio between a voice band frequency period and a non-voice band frequency period in the center channel signal and may determine whether the audio object corresponds to a voice signal corresponding to a non-effect sound, based on a second analysis result.

The three-dimensional image information may include at least one from among a disparity value for each respective image object included in one image frame, location information of the image object, and a depth map of an image.

According to another aspect of an exemplary embodiment, there is provided a method of processing an audio signal, the method including receiving an audio signal including at least one audio object and three-dimensional image information; generating index information for applying a three-dimensional effect to an audio object in at least one direction from among right, left, up, down, front, and back directions, based on the three-dimensional image information; and applying a three-dimensional effect to the audio object in at least one direction from among right, left, up, down, front, and back directions, based on the index information.

The generating of the index information may include: generating the index information in the right and left directions, based on a location of the at least one audio object in the right and left directions, which is estimated by using at least one from among the maximum disparity value and the location information; generating the index information in the front and back directions, based on a depth value of the at least one audio object in the front and back directions, which is estimated by using at least one from among the maximum and minimum disparity value; and generating the index information in the up and down directions, based on a location of the at least one audio object in the up and down directions, which is estimated by using at least one from among the maximum disparity value and the location information.

The method of processing an audio signal may further include determining whether the at least one audio object corresponds to an image object, wherein the generating of the index information includes, when the at least one audio object and the image object do not correspond to each other, generating the index information so as to reduce a three-dimensional effect of the at least one audio object.

The method of processing an audio signal may further include determining whether the at least one audio object corresponds to a non-effect sound, wherein the generating of the index information includes, when the at least one audio object corresponds to the non-effect sound, generating the index information so as to reduce a three-dimensional effect of the at least one audio object.

According to yet another exemplary embodiment, there is provided a method of processing an audio signal, the method including: receiving an audio signal corresponding to a three-dimensional image; and applying a three-dimensional effect to the audio signal, based on three-dimensional effect information for the three-dimensional image. The three-dimensional effect information may include at least one from among depth information and location information about the three-dimensional image.

The applying of the three-dimensional effect to the audio signal may include processing the audio signal such that a user senses if a location of a sound source is changed to correspond to movement of an object included in the three-dimensional image. Also, the applying of the three-dimensional effect to the audio signal includes rendering the audio signal in a plurality of directions, based on index information indicating at least one from among a depth, right and left extension, and sense of elevation of the three-dimensional image.

BRIEF DESCRIPTION OF THE DRAWINGS

The above and other features will become more apparent by describing in detail exemplary embodiments with reference to the attached drawings in which.

DETAILED DESCRIPTION OF EXEMPLARY EMBODIMENTS

Hereinafter, a method and apparatus for processing an audio signal will be described with regard to exemplary embodiments, with reference to the attached drawings. Expressions such as "at least one of," when preceding a list of elements, modify the entire list of elements and do not modify the individual elements of the list.

Firstly, for convenience of description, terminologies used herein are briefly defined as follows.

An image object denotes an object included in an image signal or a subject such as a person, an animal, a plant, a background, and the like.

An audio object denotes a sound component included in an audio signal. Various audio objects may be included in one audio signal. For example, in an audio signal generated by recording an orchestra performance, various audio objects generated from various musical instruments such as guitars, violins, oboes, and the like are included.

A sound source is an object (for example, a musical instrument or vocal band) that generates an audio object. In this specification, both an object that actually generates an audio object and an object that recognizes that a user generates an audio object denote a sound source. For example, when an apple is thrown toward a user from a screen while the user watches a movie, audio (audio object) generated when the apple is moving may be included in an audio signal. In this case, a sound itself that is generated when the apple is thrown toward the user corresponds to the audio object. The audio object may be obtained by recording a sound actually generated when an apple is thrown or may be a previously recorded audio object that is simply reproduced. However, in either case, a user recognizes that an apple generates the audio object and thus the apple may be a sound source as defined in this specification.

Three-dimensional image information includes information required to three-dimensionally display an image. For example, the three-dimensional image information may include at least one of image depth information indicating a depth of an image and location information indicating a location of an image object on a screen. The image depth information indicates a distance between an image object and a reference location. The reference location may correspond to a surface of a display device. In detail, the image depth information may include disparity of the image object. In this case, disparity refers to a distance between a left viewpoint image and a right viewpoint image, which corresponds to binocular disparity.

Figure 1:
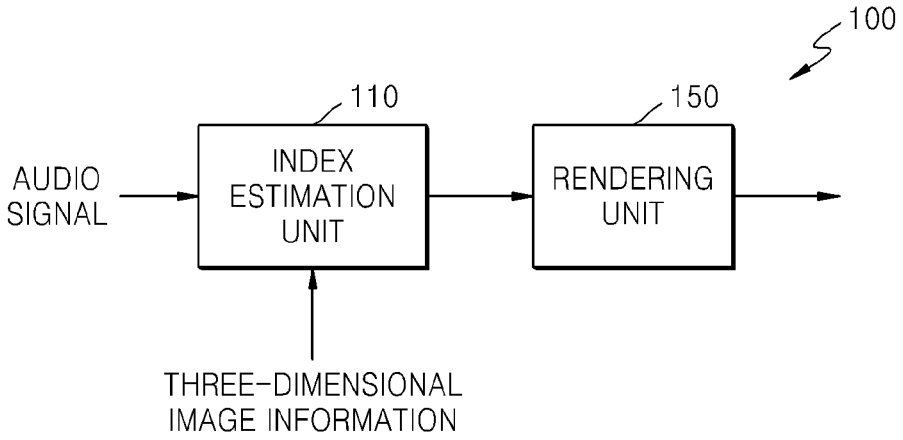
FIG. 1 is a block diagram of an audio signal processing apparatus according to an exemplary embodiment.

FIG. 1 is a block diagram of an audio signal processing apparatus 100 according to an exemplary embodiment.

Referring to FIG. 1, the audio signal processing apparatus 100 includes an index estimation unit 110 and a rendering unit 150.

The index estimation unit 110 receives three-dimensional image information as an input and generates index information to be applied to an audio object, based on the three-dimensional image information. The three-dimensional image information may be input on at least one image frame-by-frame basis. For example, a 24 Hz image includes 24 frames per second and three-dimensional image information may be input for 24 image frames per second. In addition, three-dimensional image information may be input for respective even frames. In the above-example, three-dimensional image information may be input per second for respective 12 image frames.

In this case, the index information is information for applying a three-dimensional effect to the audio object in at least one direction of right, left, up, down, front, and back directions. When the index information is used, the three-dimensional effect may be expressed for each respective audio object in a maximum of six directions such as right, left, up, down, front, and back directions. The index information may be generated to correspond to at least one audio object included in one frame. In addition, the index information may be generated to be matched with a representative audio object in one frame.

The index information will be described in more detail with reference to FIGS. 3 through 5.

The rendering unit 150 applies a three-dimensional effect to an audio object in at least one direction of right, left, up, down, front, and back directions, based on the index information generated by the index estimation unit 110.

And, the index estimation unit 110 may receive an audio signal corresponding to a three-dimensional image.

And, the rendering unit 150 may apply a three-dimensional effect to the audio signal received in the index estimation unit 110, based on three-dimensional effect information for the three-dimensional image.

Figure 2:
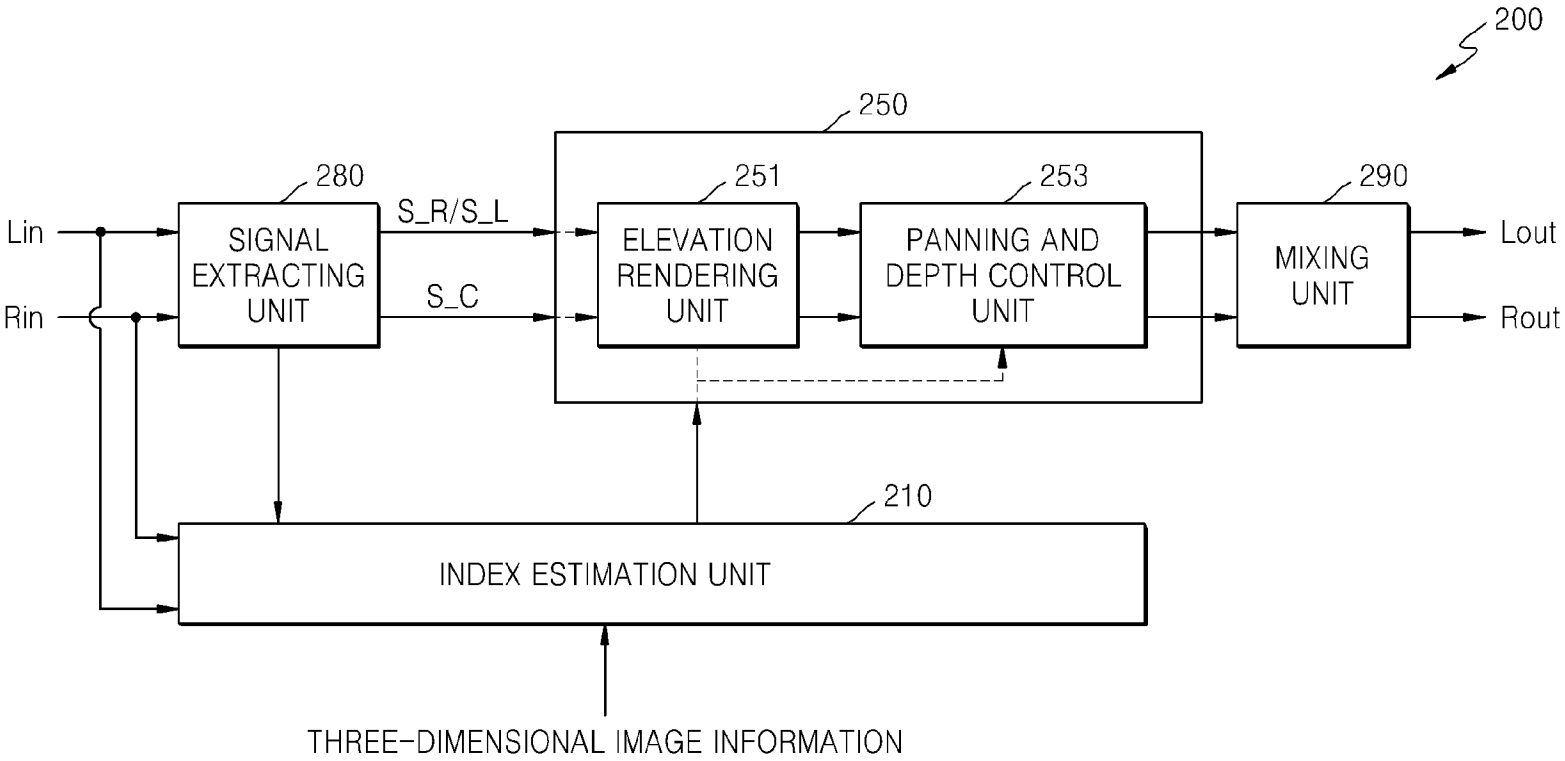
FIG. 2 is a block diagram of an audio signal processing apparatus according to another exemplary embodiment.

FIG. 2 is a block diagram of an audio signal processing apparatus 200 according to another exemplary embodiment.

Referring to FIG. 2, the audio signal processing apparatus 200 may further include at least one of a signal extracting unit 280 and a mixing unit 290, compared with the audio signal processing apparatus 100 of FIG. 1. An index estimation unit 210 and a rendering unit 250 respectively correspond to the index estimation unit 110 and the rendering unit 150 of FIG. 1 and thus their description will not be repeated herein.

The signal extracting unit 280 receives stereo audio signals (Lin and Rin) as inputs and divides the stereo audio signals (Lin and Rin) into a right/left signal (S_R/S_L) corresponding to a right/left region and a center channel signal (S_C) corresponding to a central region. Then, the right/left signal (S_R/S_L) and the center channel signal (S_C) that are divided from the stereo audio signals are transmitted to the rendering unit 250. In this case, a stereo audio signal may include a left-channel (L-channel) audio signal (Lin) and a right-channel (R_channel) audio signal (Rin).

In detail, the signal extracting unit 280 may generate the center channel signal (S_C) by using a coherence function and a similarity function between the L-channel audio signal (Lin) and the R-channel audio signal (Rin) and may generate the right/left signal (S_R/S_L) that corresponds to the L-channel audio signal (Lin) and the R-channel audio signal (Rin). In detail, the right/left signal (S_R/S_L) may be generated by subtracting partially or entirely the center channel signal (S_C) from the stereo audio signals (Lin and Rin).

The index estimation unit 210 may generate as the index information at least one of sound extension information in right and left directions, depth information in front and back directions, and elevation information in up and down directions, based on the three-dimensional image information. In this case, the sound extension information, the depth information, and the elevation information may be generated as a value that is matched with an audio object included in an audio signal. The audio signal that is input to the index estimation unit 210 in order to generate the index information, may include at least one of the right/left signal (S_R/S_L) and the center channel signal (S_C) that are generated by the signal extracting unit 280, and the stereo audio signals (Lin and Rin).

The three-dimensional image information that is input to the index estimation unit 210 is information for applying a three-dimensional effect to an image object included in a three-dimensional frame. In detail, the three-dimensional image information may include a maximum disparity value, a minimum disparity value, and location information of an image object having at least one of a maximum or minimum disparity value, for each respective image frame. In addition, the three-dimensional image information may include at least one of a disparity value of an image object, for example, main image object, in an image frame and location information of the main image object. Alternatively, the three-dimensional image information may contain a depth map of an image.

When the three-dimensional image information is input for each respective frame, the location information of the image object may include information about a sub-frame obtained by dividing one screen corresponding to one frame into at least one sub-frame. The location information of the image object will be described below in more detail with reference to FIGS. 3, 4, and 5.

Figure 3:
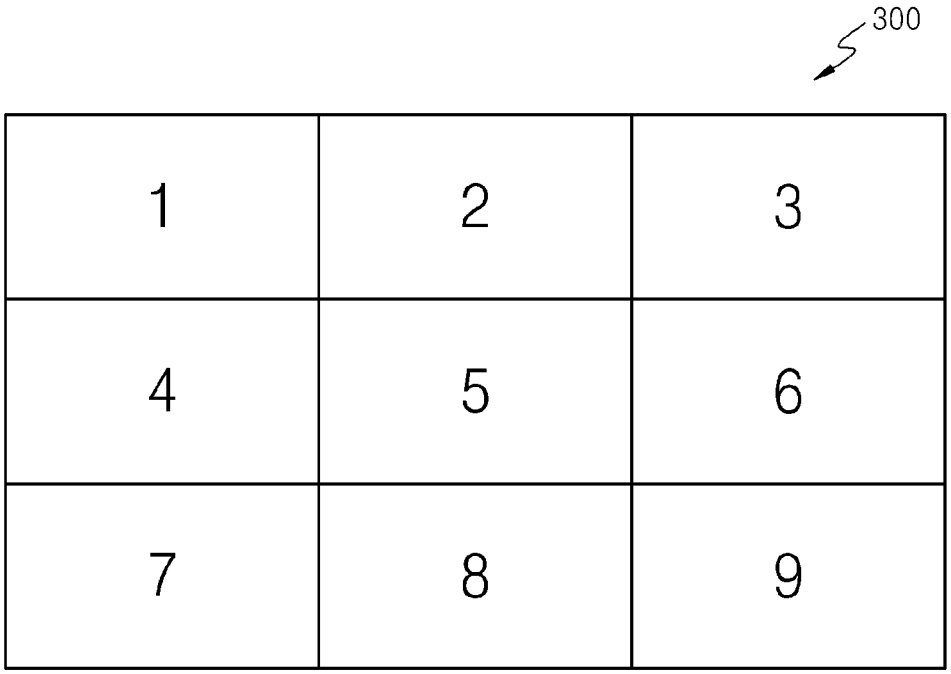
FIG. 3 is a diagram for explaining three-dimensional image information that is used in an audio signal processing apparatus, according to an exemplary embodiment.

FIG. 3 is a diagram for explaining three-dimensional image information that is used in an audio signal processing apparatus, according to an exemplary embodiment.

FIG. 3 shows a case where a screen 300 corresponding to one frame is divided into 9 sub-frames. Location information of an image object may be represented as information about the shown sub-frames. For example, sub-frame numbers, for example, 1 to 9 may be assigned to the respective sub-frames, and a sub-frame number corresponding to a region where an image object is located may be set as location information of the image object.

In detail, when an image object is located in a sub-frame 3, location information of the image object may be represented by 'sub-frame number=3'. When an image object is located across sub-frames 4, 5, 7, and 8, location information of the image object may be represented by 'sub-frame number=4, 5, 7 8,'.

Figure 4A:
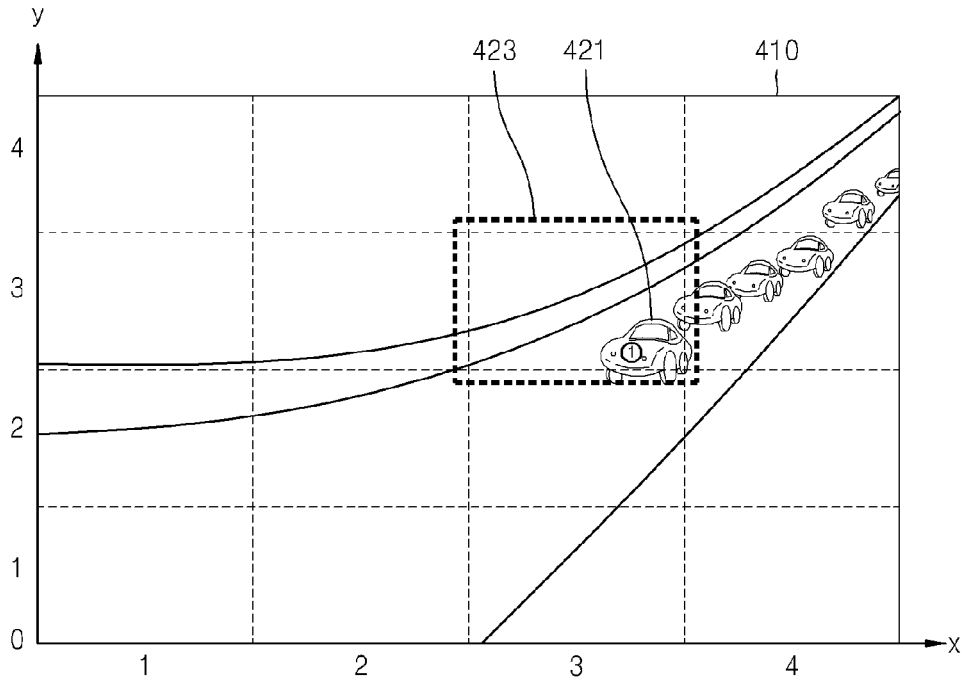
FIGS. 4A and 4B are diagrams for explaining three-dimensional image information that is used in an audio signal processing apparatus, according to an exemplary embodiment.
Figure 4B:
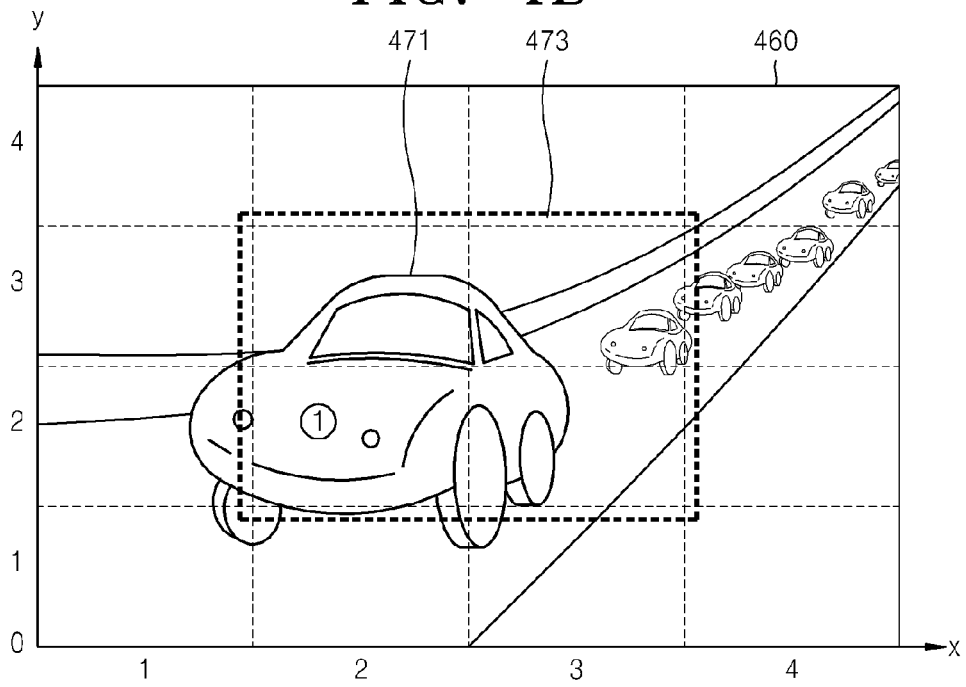

FIGS. 4A and 4B are diagrams for explaining three-dimensional image information that is used in an audio signal processing apparatus, according to an exemplary embodiment.

The index estimation unit 210 receives three-dimensional image information corresponding to respective consecutive frames as an input. FIG. 4A shows an image corresponding to one frame from among consecutive frames. FIG. 4B shows an image of a subsequent frame of the frame of FIG. 4A from among consecutive frames. FIGS. 4A and 4B show a case where the frame of FIG. 3 is divided into 16 sub-frames. In image screens 410 and 460 shown in FIGS. 4A and 4B, the x-axis indicates right and left directions of an image and the y-axis indicates up and down directions of an image. In addition, a sub-frame may be represented by using a value 'x_y'. For example, a location value of a sub-frame 423 of FIG. 4 may be represented by '3_3'.

As disparity increases, binocular disparity increases and thus a user recognizes that an object is closer. As disparity reduces, binocular disparity reduces and thus the user recognizes that the object is farther. For example, in a case of a two-dimensional image, there is no binocular disparity and thus a depth value may be 0. In addition, as an object is closer to a user, binocular disparity increases and thus a depth value may increase.

Referring to FIG. 4A, in the image screen 410 corresponding to one frame, a maximum disparity value may be applied to an image object 421 and the maximum disparity value applied to the image object 421 may be included in three-dimensional image information. In addition, information indicating a location of the sub-frame 423, which is location information of the image object 421 having a maximum disparity value, for example, 'sub-frame number=3_3' may be included in the three-dimensional image information.

Referring to FIG. 4B, the image screen 460 may be displayed at a subsequent point of time when the image screen 410 is displayed.

In the image screen 460 corresponding to a subsequent frame, a maximum disparity value may be applied to an image object 471, and the maximum disparity value applied to the image object 471 may be included in three-dimensional image information. In addition, information indicating a sub-frame 473, which is location information of the image object 471 having a maximum disparity value, for example, 'sub-frame number=2_2, 2_3, 3_2, 3_3', may be included in the three-dimensional image information.

The image object 421 shown in FIG. 4A may be displayed as the image object 471 at a subsequent point of time. That is, a user may watch an image of a moving vehicle through the image screens 410 and 460 that are consecutively displayed. Since the vehicle that is the image object 471 generates a sound while moving, the vehicle that is the image object 471 may be a sound source. In addition, the sound generated when the vehicle moves may correspond to an audio object.

The index estimation unit 210 may generate index information corresponding to an audio object, based on the input three-dimensional image information. The index information will be described below in detail with reference to FIG. 5.

Figure 5:
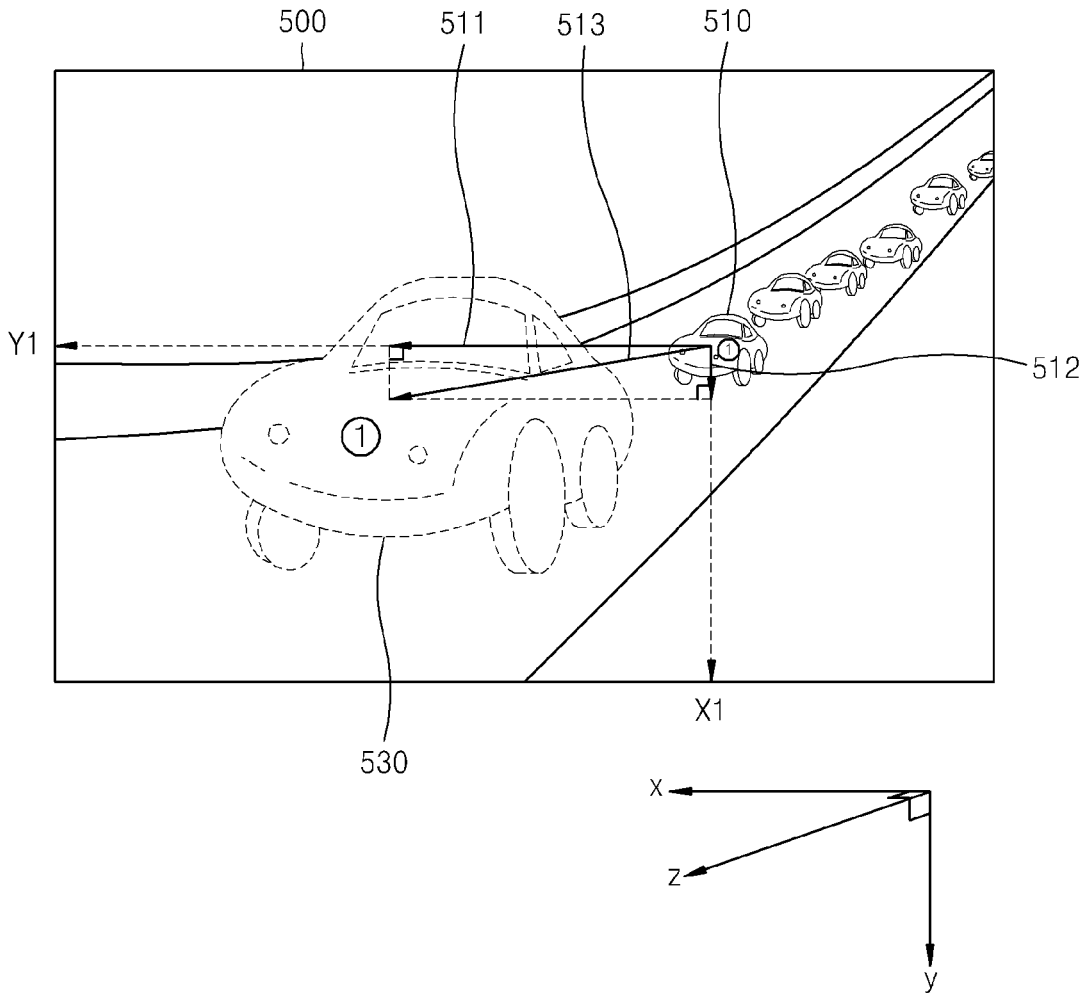
FIG. 5 is a diagram for explaining index information that is generated by an audio signal processing apparatus, according to an exemplary embodiment.

FIG. 5 is a diagram for explaining index information that is generated by an audio signal processing apparatus, according to an exemplary embodiment.

The index information may include at least one of sound extension information, depth information, and elevation information. The sound extension information is information for applying a three-dimensional effect to an audio object in right and left directions of an image screen. The depth information is information for applying a three-dimensional effect to the audio object in front and back directions of the image screen. In addition, the elevation information is information for applying a three-dimensional effect to the audio object in up and down directions of the image screen. In detail, the right and left directions may correspond to an x-axis direction, the up and down directions may correspond to a y-axis direction, and the front and back directions may correspond to a z-axis direction.

An image screen 500 shown in FIG. 5 corresponds to the image screen 410 shown in FIG. 4A. In addition, an image object 530 indicated by dotted lines corresponds to the image object 471 shown in FIG. 4B. Like in a case shown in FIGS. 4A, 4B, and 5, when a vehicle generates a sound while moving, an audio object in one frame corresponds to an image object 510. Hereinafter, an operation of generating index information when an audio object corresponds to an image object will be described in detail.

Sound extension information may be obtained based on a location of an audio object in right and left directions, which is estimated by using a maximum disparity value included in three-dimensional image information and location information of an image object.

In detail, when three-dimensional image information includes a maximum disparity value and location information of the image object 510, the index estimation unit 210 may estimate a location of an audio object corresponding to the image object 510 in right and left directions by using the three-dimensional image information. Then, sound extension information may be generated so as to generate an audio object that is recognized at the estimated location. For example, since the location of the image object 510 in right and left directions is a point X1, the sound extension information may be generated so as to generate the audio object at the point X1. In addition, how close the image object 510 is located to a user may be determined in consideration of the maximum disparity value of the image object 510. Thus, the sound extension information may be generated such that as the image object 510 is closer to the user, an audio output or sound is increased.

As shown in FIG. 5, when the image object 510 corresponding to an audio object is right on the image screen 500, the index estimation unit 210 may generate sound extension information such that a signal of a right channel may be amplified and output compared with a signal of a left channel.

The depth information may be obtained based on a depth value of an audio object in front and back directions, which is estimated by using a maximum or minimum disparity value included in three-dimensional image information.

The index estimation unit 210 may set the depth value of the audio object in proportion to the depth value of the image object.

In detail, when three-dimensional image information includes a maximum or minimum disparity value of the image object 510, the index estimation unit 210 may estimate depth information, that is, a depth of an audio object corresponding to the image object 510 by using the three-dimensional image information. In addition, depth information may be generated so as to increase an audio output or sound according to the estimated depth value of the audio object.

The elevation information may be obtained based on a location of an audio object corresponding to the image object 510 in up and down directions, which is estimated by using a maximum disparity value included in three-dimensional image information and location information.

In detail, when three-dimensional image information includes the maximum disparity value of the image object 510 and location information, the index estimation unit 210 may estimate the location of the audio object corresponding to the image object 510 in up and down directions by using the three-dimensional image information. In addition, the elevation information may be generated so as to generate an audio object that is recognized at the estimated location.

For example, since the location of the image object 510 in up and down directions is a point Y1, the elevation information may be generated so as to generate the audio object at the point Y1. In addition, how close the image object 510 is located to a user may be determined in consideration of the maximum disparity value of the image object 510. Thus, the elevation information may be generated such that as the image object 510 is closer to the user, an audio output or sound is increased.

The rendering unit 250 may apply a three-dimensional effect to an audio object included in an audio signal for each of the right/left signal (S_R/S_L) and the center channel signal (S_C). In detail, the rendering unit 250 may include an elevation rendering unit 251 and a panning and depth control unit 253.

The rendering unit 250 may generate an audio signal including an audio object so as to orient the audio object to a predetermined elevation, based on the index information generated by the index estimation unit 210. In detail, the rendering unit 250 may generate the audio signal so as to reproduce an imaginary sense of elevation according to a location of the audio object in up and down directions, based on elevation information included in the index information.

For example, when an image object corresponding to an audio object is located in an upper portion, the rendering unit 250 may reproduce a sense of elevation up to the upper portion. In addition, when the image object corresponding to the audio object is located in a lower portion, the rendering unit 250 may reproduce a sense of elevation up to the lower portion. When the image object continuously moves from an intermediate portion to an upper portion of an image screen, the rendering unit 250 may also reproduce an imaginary sense of elevation over the lower portion of the image screen in order to emphasize the sense of elevation.

In order to reproduce an imaginary sense of elevation, the rendering unit 250 may render an audio signal by using a head-related transfer function (HRTF).

The panning and depth control unit 253 may generate an audio signal including an audio object so as to orient the audio object to a predetermined point and to have a predetermined depth, based on the index information generated by the index estimation unit 210. In detail, the panning and depth control unit 253 may generate the audio signal such that a user that is located at a predetermined location in right and left directions may recognize an audio output or sound corresponding to a depth value, based on the sound extension information and depth information included in the index information.

For example, when a depth value of an audio object corresponding to the image object 510 is high, a sound is located close to the user. Thus, the panning and depth control unit 253 may increase an audio output, in the above-described example. When the depth value of the audio object corresponding to the image object 510 is low, the sound is far from the user. Thus, the panning and depth control unit 253 may adjust early reflection or reverberation of the audio signal so that the user may recognize a sound that is generated from far away, in the above-described example.

When the panning and depth control unit 253 determines that an audio object corresponding to an image object is right or left on the image screen 500, based on sound extension information, the panning and depth control unit 253 may render an audio signal such that a signal of a left channel or a signal of a right channel may be amplified and output.

Referring to FIG. 5, another frame including the image object 530 is output as a subsequent frame of one frame including the image object 510. In response to this, the rendering unit 250 renders an audio signal corresponding to consecutive audio frames. In FIG. 5, a vehicle corresponding to the image objects 510 and 530 moves from an upper-right portion to a lower-left portion of the image screen 500 and accordingly an audio object may also move from the upper-right portion to the lower-left portion. The rendering unit 250 may apply a three-dimensional effect to the audio object in right, left, up, down, front, and back directions, for each respective frame. Thus, a user may recognize a sound generated when the vehicle moves from an upper portion to a lower portion in a direction 512, a sound generated when the vehicle moves from a right portion to a left portion in a direction 511, and a sound when the vehicle moves forward.

Figure 6:
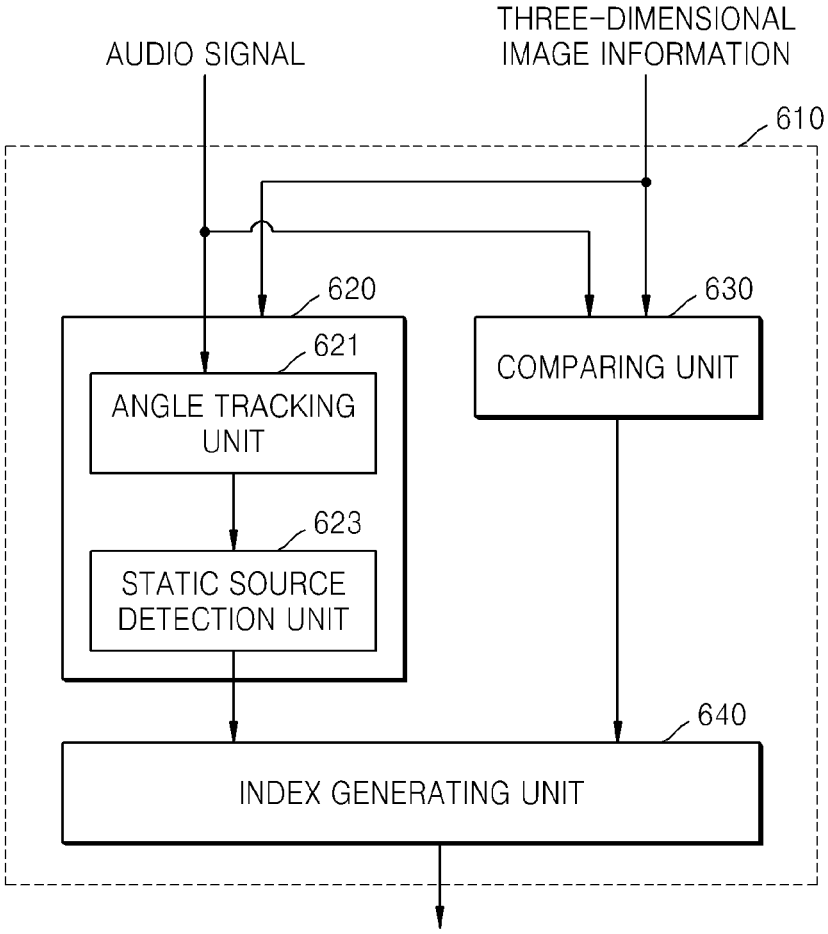
FIG. 6 is a block diagram of an index estimation unit obtained by modifying an index estimation unit of FIG. 1, according to an exemplary embodiment.

FIG. 6 is a diagram of an index estimation unit 610 obtained by modifying the index estimation unit 110 of FIG. 1, according to an exemplary embodiment. The index estimation unit 610 of FIG. 6 may correspond to the index estimation unit 110 of FIG. 1 or the index estimation unit 210 of FIG. 2 and thus its description will not be repeated herein. Thus, in at least one case from among a case when an audio object and an image object do not correspond to each other and a case when an audio object corresponds to a non-effect sound, the index estimation unit 610 may generate index information so as to reduce the three-dimensional effect of the audio object.

In detail, the case where the audio object does not correspond to the image object corresponds to a case where the image object does not generate any sound. Like in the examples shown in FIGS. 4A, 4B, and 5, when an image object is a vehicle, the image object corresponds to an audio object that generates a sound. As another example, in an image in which a person waves his or her hand, the image object corresponds to the hand. However, since no sound is generated when a person waves his or her hand, the image object does not correspond to the audio object and the index estimation unit 610 generates index information so as to minimize the three-dimensional effect of the audio object. In detail, a depth value of the depth information may be set as a basic offset value and sound extension information may be set such that audio signals output from right and left channels may have the same amplitude. In addition, elevation information may be set such that an audio signal corresponding to predetermined offset elevation may be output without considering locations of upper and lower portions.

When an audio object is a non-effect sound, a static sound source like in a case a location of an audio object barely changes may be used. For example, human voice, a piano sound at a fixed location, a background sound, or the like is a static sound source, and a location of a sound source is not significantly changed. Thus, with respect to a non-effect sound, index information may be generated so as to minimize a three-dimensional effect. A non-effect sound and an effect sound will be described in detail with reference to FIGS. 7 and 8.

Referring to FIG. 6, the index estimation unit 210 may include a sound source detection unit 620, a comparing unit 630, and an index generating unit 640.

The sound source detection unit 620 may receive at least one of the stereo audio signals (Lin and Rin), and the right/left signal (S_R/S_L) and the center channel signal (S_C) as an input audio signal, may analyze at least one of a direction angle or a direction vector of the input audio signal and energy for each respective frequency band, and may distinguish the effect sound and the non-effect sound based on the analysis result.

The comparing unit 630 determines whether the audio object and the image object correspond to each other.

In at least one case from among a case when the audio object and the image object do not correspond to each other and a case when the audio object is a non-effect sound, the index generating unit 640 generates index information so as to reduce or minimize the three-dimensional effect of the audio object.

Figure 7A:
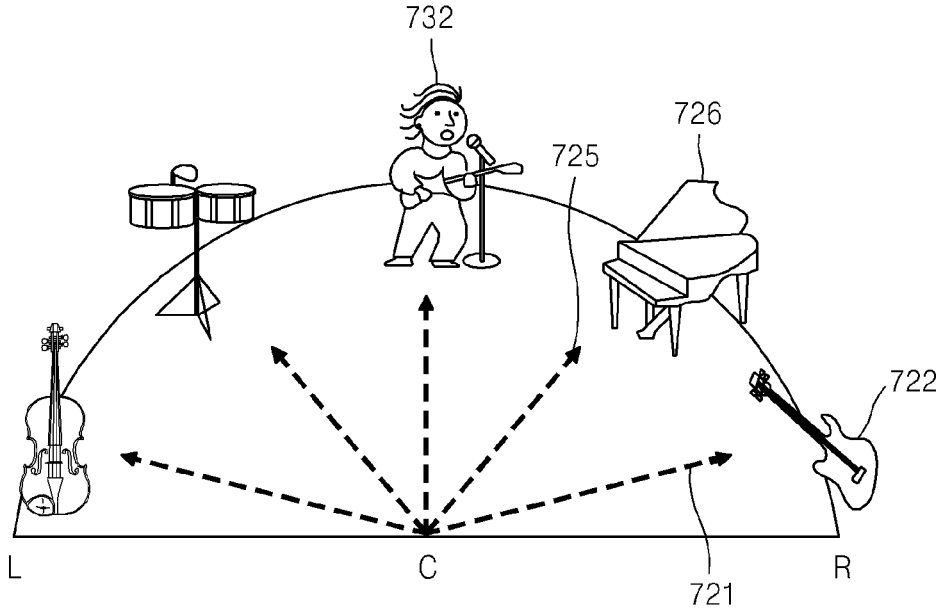
FIGS. 7A to 7C are diagrams for explaining a non-effect sound, according to an exemplary embodiment.
Figure 7B:
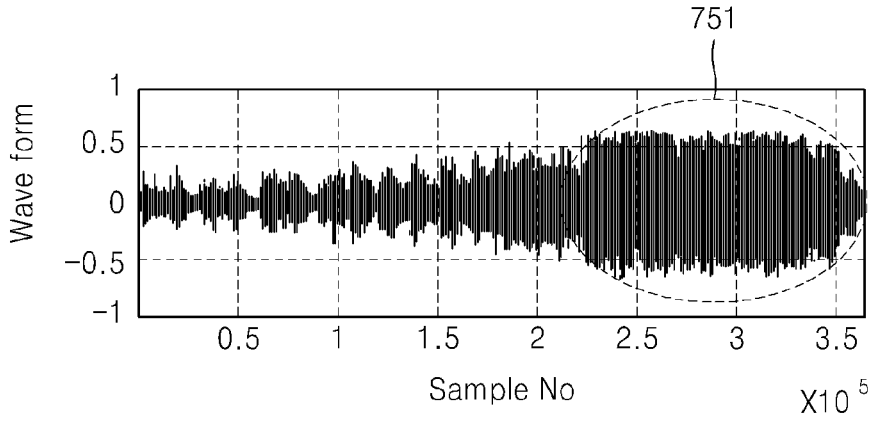
Figure 7C:
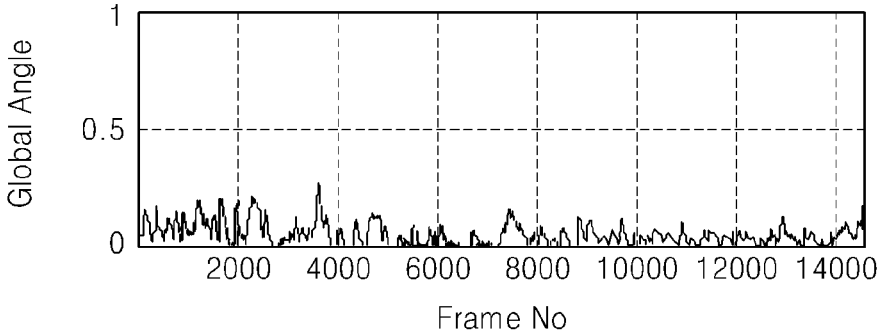

FIGS. 7A to 7C are diagrams for explaining a non-effect sound, according to an exemplary embodiment. FIG. 7A is a diagram for explaining an audio object that generates a non-effect sound, and a panning angle and a global angle, which correspond to the audio object. FIG. 7B is a diagram showing a change in waveform of an audio signal corresponding to a non-effect sound as time elapses. FIG. 7C is a diagram showing a change in global angle of a non-effect sound according to a frame number.

Referring to FIG. 7A, examples of the non-effect sound may include a voice of a person 732, sounds of musical instruments 722 and 726, or the like.

Hereinafter, an angle of a direction in which the non-effect sound is generated may be referred to as a panning angle. In addition, an angle at which the non-effect sound converges may be referred to as a global angle. Referring to FIG. 7A, when a sound source is music generated from the musical instruments 722 and 726, a global angle converges to a central point C. That is, when a user listens to a sound of a guitar, which is the musical instrument 722, the user recognizes a static sound source having a panning angle that is formed from the central point C in a direction 721. In addition, when the user listens to a sound of a piano, which is the musical instrument 726, the user recognizes a static sound source having a panning angle that is formed from the central point C in a direction 725.

A panning angle and a global angle of a sound source may be estimated by using a direction vector of an audio signal including an audio object. The panning angle and the global angle may be estimated by an angle tracking unit 621 that will be described below or a controller (not shown) of the audio signal processing apparatus 100 or 200. With regard to a non-effect sound, a change in panning angle and a change in global angle are low.

Referring to FIG. 7B, the x-axis indicates a sample number of an audio signal and the y-axis indicates a waveform of the audio signal. With regard to a non-effect sound, an amplitude of the audio signal may be reduced or increased in a predetermined period, according to an intensity of a sound output from an instrument. A region 751 may correspond to a waveform of an audio signal when an instrument outputs a sound having high intensity.

Referring to FIG. 7C, the x-axis indicates a sample number of an audio signal and the y-axis indicates a global angle. Referring to FIG. 7C, a non-effect sound such as a sound of an instrument or a voice has a small change in global angle. That is, since a sound source is static, a user may recognize an audio object that does not significantly move.

Figure 8A:
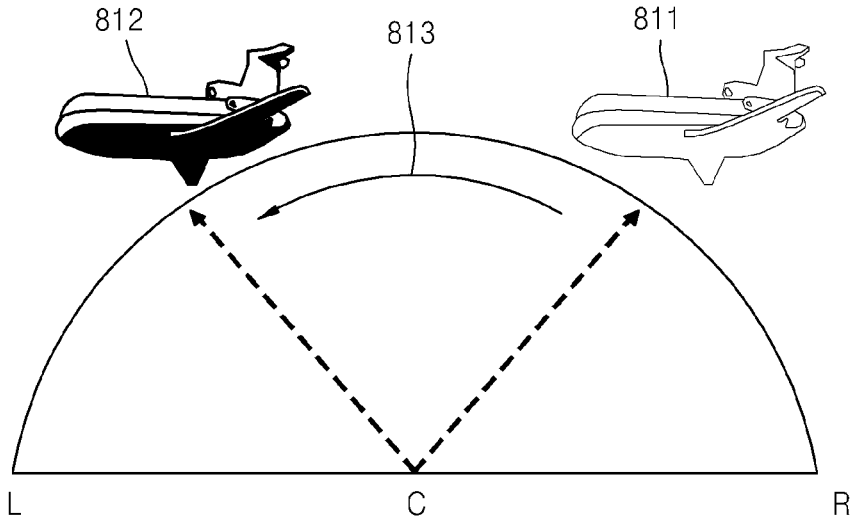
FIGS. 8A to 8C are diagrams for explaining an effect sound, according to an exemplary embodiment.
Figure 8B:
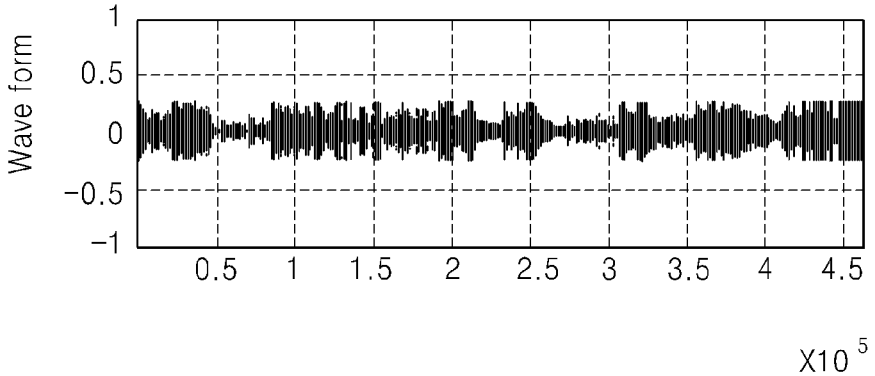
Figure 8C:
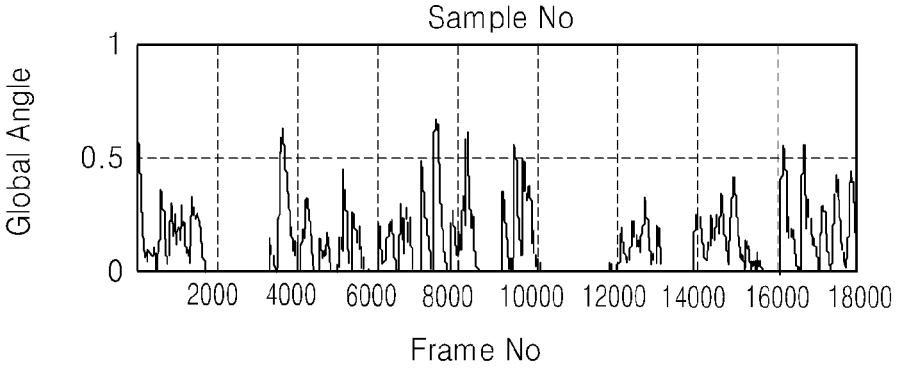

FIGS. 8A to 8C are diagrams for explaining an effect sound, according to an exemplary embodiment. FIG. 8A is a diagram for explaining an audio object that generates an effect sound, and a panning angle and a global angle, which correspond to the audio object. FIG. 8B is a diagram showing a change in waveform of an audio signal corresponding to an effect sound as time elapses. FIG. 8C is a diagram showing a change in global angle of an effect sound according to a frame number.

Referring to FIG. 8A, examples of the effect sound may be a sound that is generated when an audio object moves continually. For example, the effect sound may be a sound that is generated while an airplane at a point 811 moves to a point 812 in a predetermined direction 813. That is, examples of the effect sound may include sounds that are generated while audio objects such as air planes, vehicles, or the like move.

Referring to FIG. 8A, with regard to an effect sound such as a sound generated while an airplane moves, a global angle moves in a direction 813. That is, with regard to the effect sound, the global angle moves toward right and left surroundings, instead of a predetermined central point. Thus, when a user listens to the effect sound, the user recognizes a dynamic source that moves in right and left directions.

Referring to FIG. 8B, the x-axis indicates a sample number of an audio signal and the y-axis indicates a waveform of the audio signal. With regard to an effect sound, a change in intensity of generated sound is low and a change in amplitude of the audio signal occurs in real time. That is, unlike in FIG. 7B, there is no period in which an amplitude is increased or reduced overall.

Referring to FIG. 8C, the x-axis indicates a sample number of an audio signal and the y-axis indicates a global angle. Referring to FIG. 8C, an effect sound have a high change in global angle. That is, since a sound source is dynamic, a user may recognize an audio object that moves.

In detail, the sound source detection unit 620 may receive the stereo audio signals (Lin and Rin) as an input, may track a direction angle of the audio object included in the stereo audio signals (Lin and Rin), and may distinguish an effect sound and a non-effect sound based on the track result. In this case, the direction angle may be the above-described global angle, the above-described panning angle, or the like.

In detail, the sound source detection unit 620 may include the angle tracking unit 621 and a static source detection unit 623.

The angle tracking unit 621 tracks the direction angle of an audio object included in consecutive audio frames. In this case, the direction angle may include at least one of the above-described global angle, the above-described panning angle, and a front and back angle. In addition, the track result may be transmitted to the static source detection unit 623.

In detail, the angle tracking unit 621 may track the direction angle in right and left directions according to an energy ratio between a stereo audio signal of L-channel and a stereo audio signal of R-channel in a stereo audio signal. In addition, the angle tracking unit 621 may track the front and back angle that is a direction angle in a front and back direction according to an energy ratio between the right/left signal (S_R/S_L) and the center channel signal (S_C).

The static source detection unit 623 may distinguish a non-effect sound and an effect sound, based on the track result of the angle tracking unit 621.

In detail, when the direction angle that is tracked by the angle tracking unit 621 converges to a central point C, as shown in FIG. 7A, or when a change in the direction angle is equal to or lower than a predetermined value, the static source detection unit 623 may determine that the audio object may correspond to a non-effect sound.

In addition, when the direction angle that is tracked by the angle tracking unit 621 converges in right and left directions, as shown in FIG. 8A, or when a change in the direction angle is equal to or greater than a predetermined value, the static source detection unit 623 may determine that the audio object may correspond to an effect-sound.

The static source detection unit 623 may analyze an energy ratio of a high frequency region between the right/left signal (S_R/S_L) and the center channel signal (S_C). Then, when an energy ratio of the right/left signal (S_R/S_L) is lower than an energy ratio of the center channel signal (S_C), the static source detection unit 623 may determine that the audio object may correspond to the non-effect sound. In addition, when the energy ratio of the right/left signal (S_R/S_L) is higher than the energy ratio of the center channel signal (S_C), the static source detection unit 623 may determine that the audio object moves in a right or left direction and thus the static source detection unit 623 may determine that the audio object may correspond to the effect sound.

The static source detection unit 623 may analyze an energy ratio between a voice band frequency period and a non-voice band frequency period in the center channel signal (S_C) and may determine whether the audio object corresponds to a voice signal corresponding to a non-effect sound, based on the analysis result.

The comparing unit 630 determines a right or left location of the audio object according to a direction that is obtained by the angle tracking unit 621. Then, the comparing unit 630 compares the location of the audio object with location information of an image object, included in three-dimensional image information, and determines whether the location corresponds to the location information. The comparing unit 630 transmits information about whether the location of the image object corresponds to the location of the audio object to the index generating unit 640.

The index generating unit 640 generates index information so as to increase a three-dimensional effect applied to the audio object in the above-described six directions in at least one case from among a case when the audio object is an effect sound and a case when the image object and the audio object correspond to each other, according to the results transmitted from the sound source detection unit 620 and the comparing unit 630. In addition, in at least one case from among a case when the audio object is a non-effect sound and a case when the image object and the audio object does not correspond to each other, the index generating unit 640 does not apply a three-dimensional effect to the audio object or generates index information so as to apply a three-dimensional effect according to a basic offset value.

As described above, an audio signal processing apparatus according to an exemplary embodiment may generate an audio signal having a three-dimensional effect so as to correspond to a change in a three-dimensional effect of an image screen. Thus, when a user watches a predetermined image and hears audio, the user may experience a maximum three-dimensional effect.

In addition, an audio signal processing apparatus according to an exemplary embodiment may generate an audio object having a three-dimensional effect in six directions, thereby increasing the three-dimensional effect of an audio signal.

Figure 9:
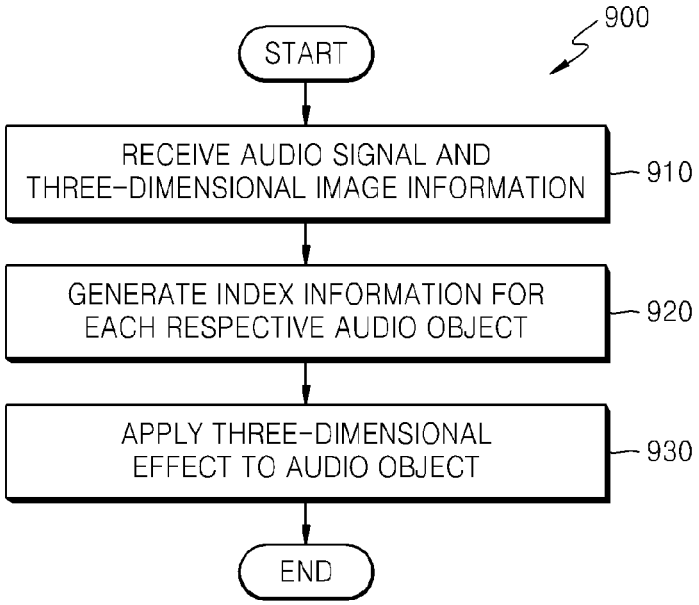
FIG. 9 is a flowchart for explaining a method of processing an audio signal, according to an exemplary embodiment.

FIG. 9 is a flowchart for explaining a method of processing an audio signal, according to an exemplary embodiment. Some operations of the method 900 according to the present exemplary embodiment are the same as operations of the audio signal processing apparatus described with reference to FIGS. 1 through 8 and thus their description will not be repeated herein. In addition, the method according to the present exemplary embodiment will be described with reference to the audio signal processing apparatus of FIGS. 1, 2, and 6.

The method 900 according to the present exemplary embodiment may include receiving an audio signal including at least one audio object and three-dimensional image information as an input (operation 910). Operation 910 may be performed by the index estimation units 110 and 210.

In operation 910, index information for applying a three-dimensional effect to the audio object in at least one direction of right, left, up, down, front, and back directions is generated based on the input three-dimensional image information (operation 920). Operation 920 may be performed by the index estimation units 110 and 210.

The three-dimensional effect is applied to an audio signal, based on the three-dimensional effect information for a three-dimensional image. In detail, the three-dimensional effect is applied to the audio object in at least one direction of right, left, up, down, front, and back directions, based on the index information generated in operation 920 (operation 930). Operation 930 may be performed by the rendering units 150 and 250.

In detail, when an audio signal is reproduced, the three-dimensional effect may be applied to the audio signal such that a user may sense as if a location of a sound source is changed to correspond to movement of an object included in the three-dimensional image.

Figure 10:
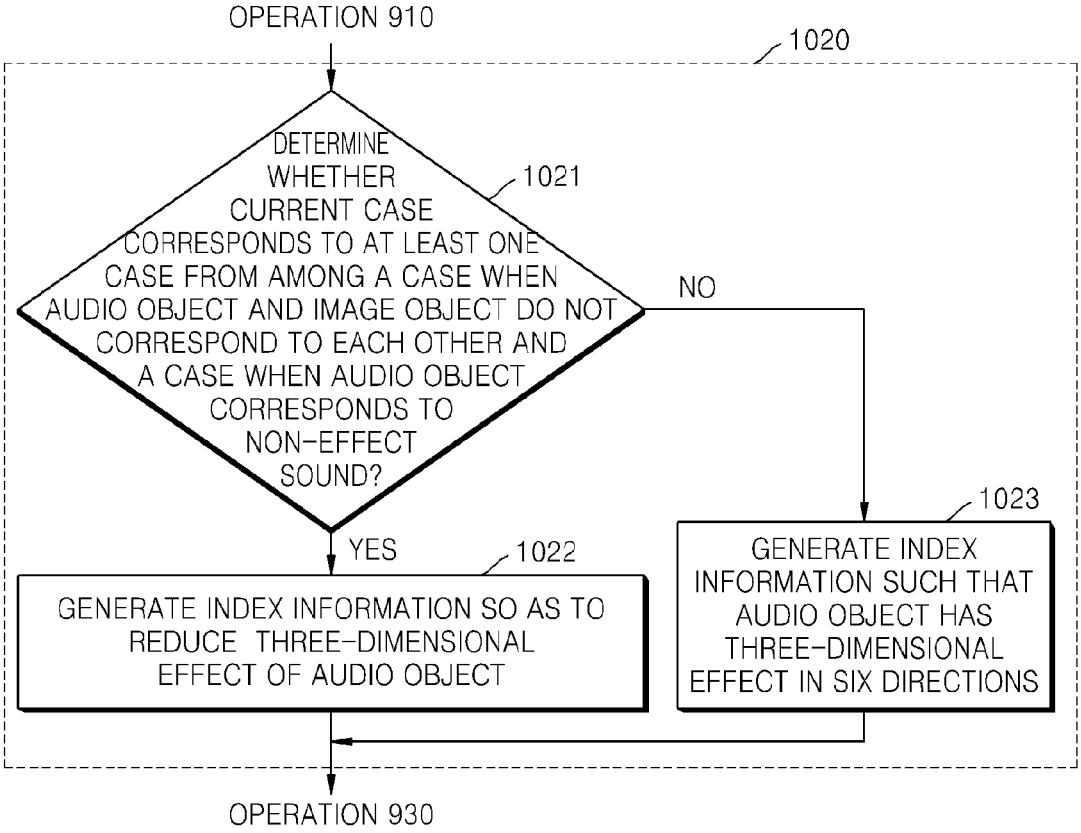
FIG. 10 is a flowchart of operation 920 of the method of FIG. 9, according to an exemplary embodiment.

FIG. 10 is a flowchart of operation 920 of the method of FIG. 9, according to an exemplary embodiment. Operation 920 corresponds to operation 1020 of FIG. 10. Hereinafter, operation 1020 will be referred to as an operation of rendering an audio signal.

Operation 1020 includes operations 1021, 1022, and 1023.

In detail, whether a current case corresponds to at least one case from among a case when an audio object and an image object do not correspond to each other and a case when the audio object corresponds to a non-effect sound, is determined (operation 1021). Operation 1021 may be performed by the index estimation units 110, 210, and 610, and more specifically, may be performed by at least one of the sound source detection unit 620 and the comparing unit 630.

As a result of the determination in operation 1021, when the current case corresponds to the at least one of the above-described cases, the index information may be generated so as to reduce the three-dimensional effect of the audio object (operation 1022). Operation 1021 may be performed by the index estimation units 110, 210, and 610, and more specifically, may be performed by the index generating unit 640.

As a result of the determination in operation 1021, when the current case does not correspond to the at least one of the above-described cases, the index information may be generated such that the audio object may have a three-dimensional effect in at least one of the above-described six directions (operation 1023). Operation 1023 may be performed by the index estimation units 110, 210, and 610, and more specifically, may be performed by the index generating unit 640.

While exemplary embodiments have been particularly shown and described with reference to exemplary embodiments thereof, it will be understood by those of ordinary skill in the art that various changes in form and details may be made therein without departing from the spirit and scope of the exemplary embodiments as defined by the following claims.

What is claimed is:

1. An audio signal processing apparatus comprising:

a memory device;

a processor which performs operations, the operations comprising:

receiving three-dimensional image information and an audio signal, and generating index information for applying a three-dimensional effect to the at least one audio object of the audio signal in at least one direction from among right, left, up, down, front, and back directions, based on the three-dimensional image information; and applying the three-dimensional effect to the at least one audio object in the at least one direction from among right, left, up, down, front, and back directions, based on the index information, wherein the three-dimensional image information comprises at least one from among a minimum disparity value, a maximum disparity value, and location information of an image object having at least one from among the maximum disparity value and the minimum disparity value, for each respective image frame.

2. The audio signal processing apparatus of claim 1, wherein the index information comprises sound extension information in the right and left directions, depth information in the front and back directions, and elevation information in the up and down directions.

3. The audio signal processing apparatus of claim 1, wherein, when the three-dimensional image information is input for each respective frame, the location information of the image object comprises information about a sub-frame obtained by dividing one screen corresponding to one frame into at least one sub-frame.

4. The audio signal processing apparatus of claim 3, wherein the sound extension information is obtained based on a location of the audio object in the right and left directions, which is estimated by using at least one from among the maximum disparity value and the location information.

5. The audio signal processing apparatus of claim 3, wherein the depth information is obtained based on a depth value of the audio object in the front and back directions, which is estimated by using at least one of the maximum and minimum disparity value.

6. The audio signal processing apparatus of claim 3, wherein the elevation information is obtained based on a location of the audio object in the up and down directions, which is estimated by using at least one from among the maximum disparity value and the location information.

7. The audio signal processing apparatus of claim 1, wherein, in at least one case from among cases when the audio object and an image object do not correspond to each other and cases when the audio object corresponds to a non-effect sound, the index information is generated so as to reduce a three-dimensional effect of the audio object.

8. The audio signal processing apparatus of claim 1, wherein the processor performs operations of receiving a stereo audio signal, extracting right/left signals and a center channel signal in the stereo audio signal, and transmitting the extracted signals to the renderer.

9. The audio signal processing apparatus of claim 8, wherein the processor performs operations of:

receiving at least one from among the stereo audio signal, the right/left signals, and the center channel signal as an audio signal, analyzing at least one from among a direction angle of the input audio signal and energy for each respective frequency band, and distinguishing the effect sound and the non-effect sound based on a first analysis result;

determining whether the audio object corresponds to the image object; and generating index information so as to reduce a three-dimensional effect of the audio object in at least one case from among cases when the image object and the audio object do not correspond to each other and cases when the audio object corresponds to the non-effect sound.

10. The audio signal processing apparatus of claim 9, wherein the at least one from among the stereo audio signal, and the right/left signal and the center channel signal is received, a direction angle of an audio object included in the stereo audio signal is tracked, and an effect sound and a non-effect sound based on a track result are distinguished between each other.

11. The audio signal processing apparatus of claim 10, wherein, when a change in the direction angle is equal to or greater than a predetermined value or when the direction angle converges in the right and left directions, the sound source detector determines that the audio object corresponds to the effect sound.

12. The audio signal processing apparatus of claim 10, wherein, when a change in the direction angle is equal to or less than a predetermined value or when the direction angle converges to a central point, it is determined that the audio object corresponds to a static sound source.

13. The audio signal processing apparatus of claim 9, wherein an energy ratio of a high frequency region between the right/left signal and the center channel signal is analyzed, and when an energy ratio of the right/left signal is lower than an energy ratio of the center channel signal, it is determined that the audio object corresponds to the non-effect sound.

14. The audio signal processing apparatus of claim 9, wherein an energy ratio between a voice frequency band and a non-voice frequency band in the center channel signal is analyzed and whether the audio object corresponds to a voice signal corresponding to a non-effect sound is determined, based on a second analysis result.

15. The audio signal processing apparatus of claim 1, wherein the three-dimensional image information comprises at least one from among a disparity value for an image object included in one image frame, location information of the image object, and a depth map of an image.

16. The audio signal processing apparatus of claim 1, wherein a first value of the three-dimensional effect or a second value of the three-dimensional effect smaller than the first value is applied to the audio object based on whether the audio object corresponds to a non-effect sound, wherein the non-effect sound is a sound from a static sound source which a location of the sound source is not significantly changed.

17. A method of processing an audio signal, the method comprising:

receiving the audio signal and three-dimensional image information;

generating index information for applying a three-dimensional effect to the at least one audio object of the audio signal in at least one direction from among right, left, up, down, front, and back directions, based on the three-dimensional image information;

applying the three-dimensional effect to the at least one audio object in the at least one direction from among right, left, up, down, front, and back directions, based on the index information, wherein the three-dimensional image information comprises at least one from among a minimum disparity value, a maximum disparity value, and location information of an image object having at least one from among the maximum disparity value and the minimum disparity value, for each respective image frame.

18. The method of claim 17, wherein the index information comprises sound extension information in the right and left directions, depth information in the front and back directions, and elevation information in the up and down directions.

19. The method of claim 18, wherein the generating of the index information comprises:

generating the index information in the right and left directions, based on a location of the at least one audio object in the right and left directions, which is estimated by using at least one from among the maximum disparity value and the location information;

generating the index information in the front and back directions, based on a depth value of the at least one audio object in the front and back directions, which is estimated by using at least one from among the maximum and minimum disparity value; and generating the index information in the up and down directions, based on a location of the at least one audio object in the up and down directions, which is estimated by using at least one from among the maximum disparity value and the location information.

20. A method of processing an audio signal, the method comprising:

receiving the audio signal and three-dimensional image information;

generating index information for applying a three-dimensional effect to the at least one audio object of the audio signal in at least one direction from among right, left, up, down, front, and back directions, based on the three-dimensional image information;

applying the three-dimensional effect to the at least one audio object in the at least one direction from among right, left, up, down, front, and back directions, based on the index information; and determining whether the at least one audio object corresponds to an image object, wherein the three-dimensional image information comprises at least one from among a minimum disparity value, a maximum disparity value, and location information of an image object having at least one from among the maximum disparity value and the minimum disparity value, for each respective image frame.

* * * * *